US009194248B2

(12) United States Patent
Patel et al.

(10) Patent No.: US 9,194,248 B2
(45) Date of Patent: Nov. 24, 2015

(54) REHEAT STEAM BYPASS SYSTEM

(75) Inventors: Kaushal Vishnubhai Patel, Greenville, SC (US); James Stewart Farrar, Malta, NY (US); William Eric Maki, Clifton Park, NY (US)

(73) Assignee: General Electric Company, Schenectady, NY (US)

( * ) Notice: Subject to any disclaimer, the term of this patent is extended or adjusted under 35 U.S.C. 154(b) by 789 days.

(21) Appl. No.: 13/491,384

(22) Filed: Jun. 7, 2012

(65) Prior Publication Data

US 2013/0330175 A1 Dec. 12, 2013

(51) Int. Cl.

| | |
|---|---|
| ***F01D 25/12*** | (2006.01) |
| ***F01D 11/06*** | (2006.01) |
| ***F01D 13/02*** | (2006.01) |

(52) U.S. Cl.

CPC ..... *F01D 11/06* (2013.01); *F01D 13/02* (2013.01); *F01D 25/12* (2013.01); *F05D 2220/31* (2013.01)

(58) Field of Classification Search

CPC ..... F01D 11/06; F01D 11/003; F01D 25/12; F01D 13/02; F01D 17/105; F01D 17/14; F01D 17/141; F01D 17/145

See application file for complete search history.

(56) References Cited

U.S. PATENT DOCUMENTS

| | | | | |
|---|---|---|---|---|
| 3,934,419 | A * | 1/1976 | Aanstad | F01D 17/24 60/660 |
| 4,355,514 | A | 10/1982 | Reifenberg | |
| 6,550,253 | B2 * | 4/2003 | Mortzheim et al. | 60/782 |
| 6,615,574 | B1 * | 9/2003 | Marks | 60/772 |
| 2003/0005702 | A1 * | 1/2003 | Taguchi | F01K 23/10 60/772 |
| 2009/0196736 | A1 * | 8/2009 | Sengar et al. | 415/115 |
| 2009/0204305 | A1 * | 8/2009 | Ishibashi | F01D 19/00 701/100 |
| 2010/0154434 | A1 * | 6/2010 | Kubota et al. | 60/785 |

FOREIGN PATENT DOCUMENTS

| | | | |
|---|---|---|---|
| CN | 2670606 | Y | 1/2005 |
| CN | 1793617 | A | 6/2006 |
| DE | 3235557 | A1 | 4/1983 |
| GB | 2107403 | A | 4/1983 |
| JP | S562403 | A | 1/1981 |
| JP | 63223311 | A | 9/1988 |
| RU | 2246009 | C2 | 2/2005 |

OTHER PUBLICATIONS

Unofficial English translation of Office Action issued in connection with corresponding CN Application No. 201310224620.9 on Jul. 27, 2015.

* cited by examiner

*Primary Examiner* — Richard Edgar
*Assistant Examiner* — Brian O Peters
(74) *Attorney, Agent, or Firm* — Ernest G. Cusick; Hoffman Warnick LLC.

(57) ABSTRACT

Various embodiments include systems for controlling the flow of main steam from a high-pressure (HP) turbine to a turbine packing. In some cases, a system is disclosed including: a high pressure (HP) turbine including a plurality of stages, the plurality of stages including an early stage, a middle stage and a later stage; an intermediate pressure (IP) turbine operably connected with the HP turbine; a packing separating the HP turbine and the IP turbine; a main conduit fluidly connecting the middle stage of the HP turbine and the packing, the main conduit including a main valve; and a bypass conduit fluidly connected to the main conduit and bypassing the main valve, the bypass conduit including: a blocking valve; and an opening between the blocking valve and a downstream connection with the main conduit.

18 Claims, 3 Drawing Sheets

REHEAT STEAM BYPASS SYSTEM

FIELD OF THE INVENTION

The subject matter disclosed herein relates to turbines. More particularly, aspects of the invention include systems for bypassing steam in a turbine.

BACKGROUND OF THE INVENTION

During operation of a turbine system employing a joint high-pressure (HP) and intermediate-pressure (IP) turbine, steam is conventionally extracted at a desired temperature from middle stages of the HP turbine section, where that steam is piped into a packing separating the HP turbine section and the IP turbine section. This extracted steam can be used to cool the packing (also known as an N2 packing) separating the HP turbine section and the IP turbine section. Conventionally, the flow of this extracted steam is controlled by one or more valves, which can be subject to fluctuations in flow that cause wear on the valves and undesirable noise.

BRIEF DESCRIPTION OF THE INVENTION

Various embodiments of the invention include systems for controlling the flow of main steam from a high-pressure (HP) turbine to a turbine packing. In some cases, a system is disclosed including: a high pressure (HP) turbine including a plurality of stages, the plurality of stages including an early stage, a middle stage and a later stage; an intermediate pressure (IP) turbine operably connected with the HP turbine; a packing separating the HP turbine and the IP turbine; a main conduit fluidly connecting the middle stage of the HP turbine and the packing, the main conduit including a main valve; and a bypass conduit fluidly connected to the main conduit and bypassing the main valve, the bypass conduit including: a blocking valve; and an opening between the blocking valve and a downstream connection with the main conduit.

A first aspect of the invention includes a system having: a high pressure (HP) turbine including a plurality of stages, the plurality of stages including an early stage, a middle stage and a later stage; an intermediate pressure (IP) turbine operably connected with the HP turbine; a packing separating the HP turbine and the IP turbine; a main conduit fluidly connecting the middle stage of the HP turbine and the packing, the main conduit including a main valve; and a bypass conduit fluidly connected to the main conduit and bypassing the main valve, the bypass conduit including: a blocking valve; and an opening between the blocking valve and a downstream connection with the main conduit.

A second aspect of the invention includes a system having: a high pressure (HP) turbine; a packing separating the HP turbine from an IP turbine; a main conduit fluidly connecting a middle stage of the HP turbine and the packing, the main conduit including a main valve; and a bypass conduit fluidly connected to the main conduit and bypassing the main valve, the bypass conduit including: a blocking valve; and an opening between the blocking valve and a downstream connection with the main conduit.

A third aspect of the invention includes a system having: at least one computing device configured to monitor a reheat steam bypass system by performing actions including: determining an operating parameter of a high-pressure (HP) turbine fluidly connected with a packing; and adjusting a position of at least one of a reheat rotor cooling valve (RHCV) or a cooling steam blocking valve (CSBV) to modify a flow of reheat steam in the reheat steam bypass system in response to the operating parameter of the HP turbine deviating from a predetermined range, wherein the RHCV and the CSBV are connected in parallel in the reheat steam bypass system.

BRIEF DESCRIPTION OF THE DRAWINGS

These and other features of this invention will be more readily understood from the following detailed description of the various aspects of the invention taken in conjunction with the accompanying drawings that depict various embodiments of the invention, in which.

Figure 1:
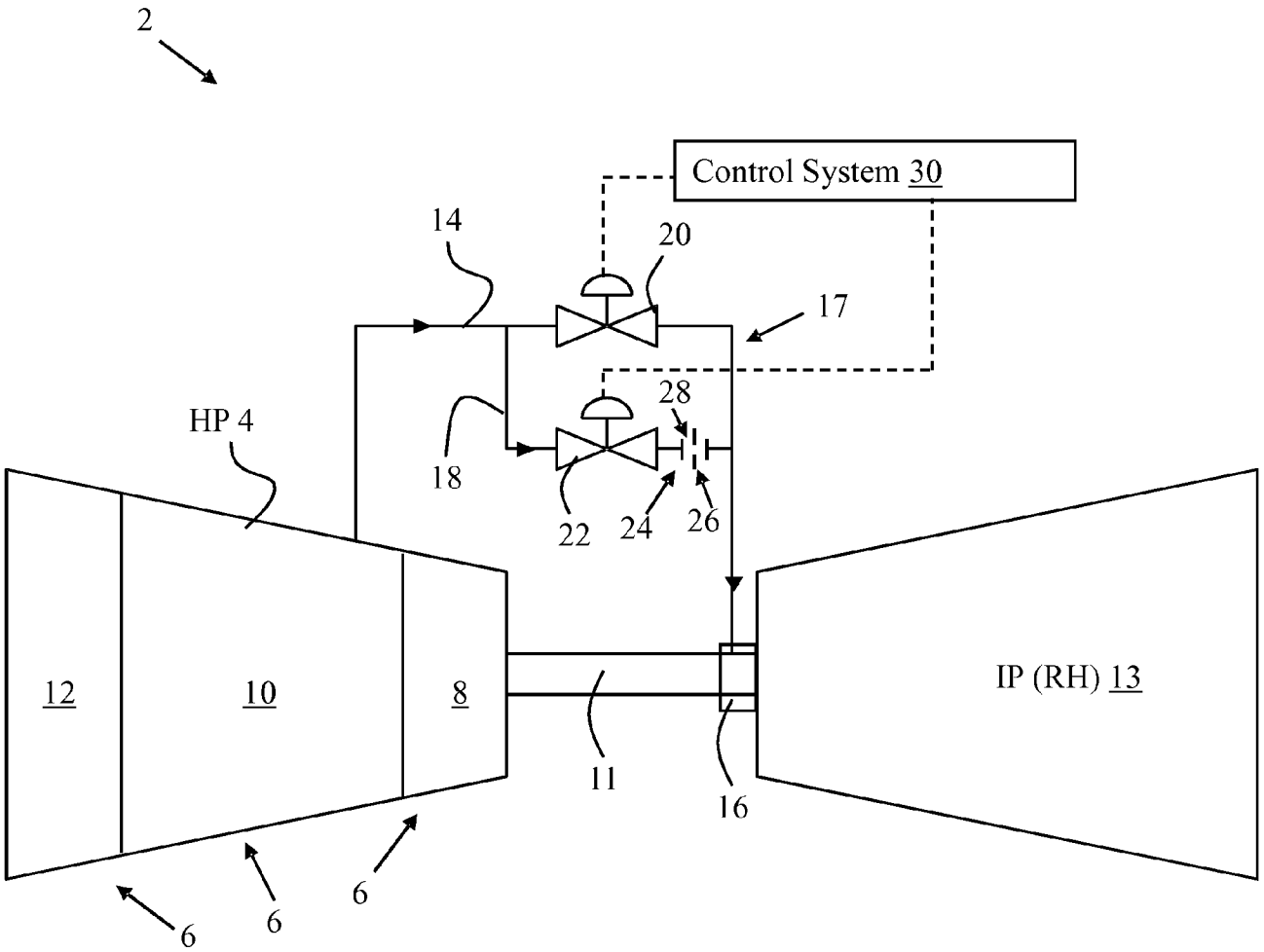
FIG. 1 shows a schematic diagram of a system according to various embodiments of the invention.

It is noted that the drawings of the invention are not necessarily to scale. The drawings are intended to depict only typical aspects of the invention, and therefore should not be considered as limiting the scope of the invention. In the drawings, like numbering represents like elements between the drawings.

DETAILED DESCRIPTION OF THE INVENTION

As noted, the subject matter disclosed herein relates to turbines. More particularly, aspects of the invention include a system for bypassing main steam in a turbine configuration.

During operation of a turbine system employing a joint high-pressure (HP) and intermediate-pressure (IP) turbine, steam is conventionally extracted at a desired temperature from middle stages of the HP turbine section, where that steam is piped into a packing separating the HP turbine section and the IP turbine section. This extracted steam can be used to cool the packing (also known as an N2 packing) separating the HP turbine section and the IP turbine section. Conventionally, the flow of this extracted steam is controlled by a reheat rotor cooling valve (RHCV) arranged in series with a cooling steam blocking valve (CSBV). The conventional RHCV is two-way ball valve, and in the conventional configuration, includes a cross-drilled hole which is sized to provide dual-flow capability. The CSBV is used to block the high-pressure steam from entering the reheat section (IP turbine section) in the case of a power interruption (e.g., a trip), a load rejection or a turbine shutdown. Where steam flow rates increase above certain levels, high levels of noise are produced in the RHCV due to the cross-drilled hole configuration. Additionally, the high steam flow rates can wear on the RHCV and the CSBV.

In contrast to this conventional configuration, various aspects of the invention include a system having a main conduit connecting the HP section and the IP section, where that main conduit includes a valve (e.g., an RHCV valve with only one-way flow capability). The RHCV differs from the RHCV described with reference to the conventional embodiments in that the RHCV does not include a cross-drilled hole. The system further includes a bypass conduit fluidly connected to the main conduit, where the bypass conduit includes a blocking valve (e.g., a CSBV valve) and an opening between the blocking valve and the connection with the main conduit. The opening can include an orifice plate for providing an outlet for back-flowing exhaust steam. This opening (which includes the orifice plate and an associated orifice) acts to meter the fluid flow during normal turbine operation (i.e., at base load).

In one particular set of embodiments, a system is disclosed including: a high pressure (HP) turbine including a plurality of stages, the plurality of stages including an early stage, a middle stage and a later stage; an intermediate pressure (IP) turbine operably connected with the HP turbine; an N2 packing separating the HP turbine and the IP turbine; a main conduit fluidly connecting the middle stage of the HP turbine and the N2 packing, the main conduit including a main valve; and a bypass conduit fluidly connected to the main conduit and bypassing the main valve, the bypass conduit including: a blocking valve; and an opening (including an orifice and orifice plate) between the blocking valve and a downstream connection with the main conduit.

Turning to FIG. 1, a schematic depiction of a system 2 is shown according to various embodiments of the invention. The system 2 can include an HP turbine 4 having a plurality of stages 6, where the plurality of stages 6 includes an early stage 8, a middle stage 10 and a later stage 12. It is understood that the terms "early", "middle" and "later" are merely relative terms describing positions of stages 6 within the HP turbine 4. Generally speaking, the middle stage 10 can be any stage between the first stage and last stage of the HP turbine 4.

Also shown, the system 2 can include an intermediate pressure (IP) turbine 13 operably connected with the HP turbine 4 (e.g., both fluidly and mechanically via a common shaft 11). The IP turbine 13 can also be referred to as a reheat turbine (RH). The IP turbine 13 and the HP turbine 4 can be fluidly connected by a main conduit 14, the details of which are described further herein. The system 2 can further include a packing (e.g., an N2 packing) 16 which separates the HP turbine 4 and the IP turbine 13 via the main conduit 14.

The system 2 can further include a bypass conduit 18 fluidly connected to the main conduit 14. As shown, the bypass conduit 18 is fluidly connected to the main conduit 14, which allows for bypassing of a section 17 of the main conduit 14. The main conduit 14 can include a main valve 20 which is adapted to control the flow of fluid (e.g., steam) through the main conduit 14. In some embodiments, the main valve 20 can include a ball valve which does not include a cross-drilled hole (as compared to the prior art). In various embodiments, the main valve 20 includes a reheat rotor cooling valve (RHCV) valve.

The bypass conduit 18 can include a blocking valve 22 and an opening 24, where the opening 24 is located between the blocking valve 22 and a downstream connection between the bypass conduit 18 and the main conduit 14. In various embodiments, the blocking valve 22 can include a cooling steam blocking valve (CSBV)). In various cases, the opening 24 can include an orifice plate 26 and an orifice 28. As shown, in various embodiments, the bypass conduit 18 is arranged in parallel with the main conduit 14, such that the bypass conduit 18 provides an alternative flow path for the extracted fluid from the mid-sections 10 of the HP turbine 4 to the packing 16. The orifice plate 26 and orifice 28 can act together to provide leak-off functions, as will be described further herein. In some embodiments, the bypass conduit 18 is adapted to allow a lesser fluid flow rate there through than the main conduit 14. That is, in some embodiments, the bypass conduit 18 has an inner diameter smaller than the inner diameter of the main conduit, e.g., 10% smaller.

In various other embodiments of the invention, the system 2 can include a control system 30 operably connected with the main valve 20 and the blocking valve 22. In some cases, the control system 30 can include an electrical, electro-mechanical, or mechanical control system adapted to modify a position of at least one of the main valve 20 or the blocking valve 22. In various embodiments, the control system is electrically, mechanically and/or electro-mechanically coupled to the main valve 20 and/or the blocking valve 22 to modify a position of at least one of those valves.

The control system 30 can further be operably connected (electrically, mechanically and/or electromechanically) to the HP turbine 4, the shaft 11, the packing 16 and/or the IP turbine 13. In some cases, the control system 30 can be configured to: a) monitor an operating parameter of the HP turbine 4; and b) adjust a position of at least one of the main valve 20 or the blocking valve 22 in response to the monitored operating parameter deviating from a predetermined range of operating parameters. In some cases, the operating parameter can include an operating load of the HP turbine 4 and/or the IP turbine 13 (e.g., shaft speed), temperature and/or pressure conditions within the HP turbine 4 and/or the IP turbine 13, fluid flow rates (e.g., through the HP turbine 4, the IP turbine, the main conduit 14 and/or the bypass conduit 18), etc.

As noted, in response to determining that the operating parameter deviates from a predetermined desirable range, the control system 30 is configured to modify a position of the main valve 20 and/or blocking valve 22, e.g., by at least partly closing or opening one or both of these valves. In some cases, the control system 30 is configured to close the main valve 20 and open the bypass valve 22 in response to determining that the operating load of the HP turbine 4 exceeds a predetermined threshold. For example, the control system 30 can monitor an operating load of the HP turbine 4, and as that operating load approaches a predetermined threshold, the control system 30 can provide instructions to actuate closing of the main valve 20. Simultaneously, or at a distinct time, the control system 30 can also provide instructions to actuate opening of the bypass valve 22. In various embodiments, the predetermined threshold (operating load) is equal to approximately 90% of the HP turbine's 4 maximum (rated) operating load. In some cases, the control system 30 triggers closing of the main valve 20 and opening of the bypass valve 22 when the determined operating load of the HP turbine 4 nearly approaches 90% of its rated load (e.g., at approximately 85-89.99% operating load). In the case that the operating load of the HP turbine 4 drops below approximately 90% of its rated maximum load, the control system 30 can provide instructions to open the main valve 20 and close the bypass valve 22.

In other embodiments, the control system 30 is configured to close both of the main valve 20 and the bypass valve 22 in response to determining a malfunction has occurred in one or both of the HP turbine 4 and the IP turbine 13. A "malfunction" can include any condition where the IP turbine 13 and/or HP turbine 4 loses power, has a sudden decrease in pressure, flow, etc., where flow of a working fluid (e.g., steam) is rejected by the IP turbine 13 or the packing 16.

Figure 2:
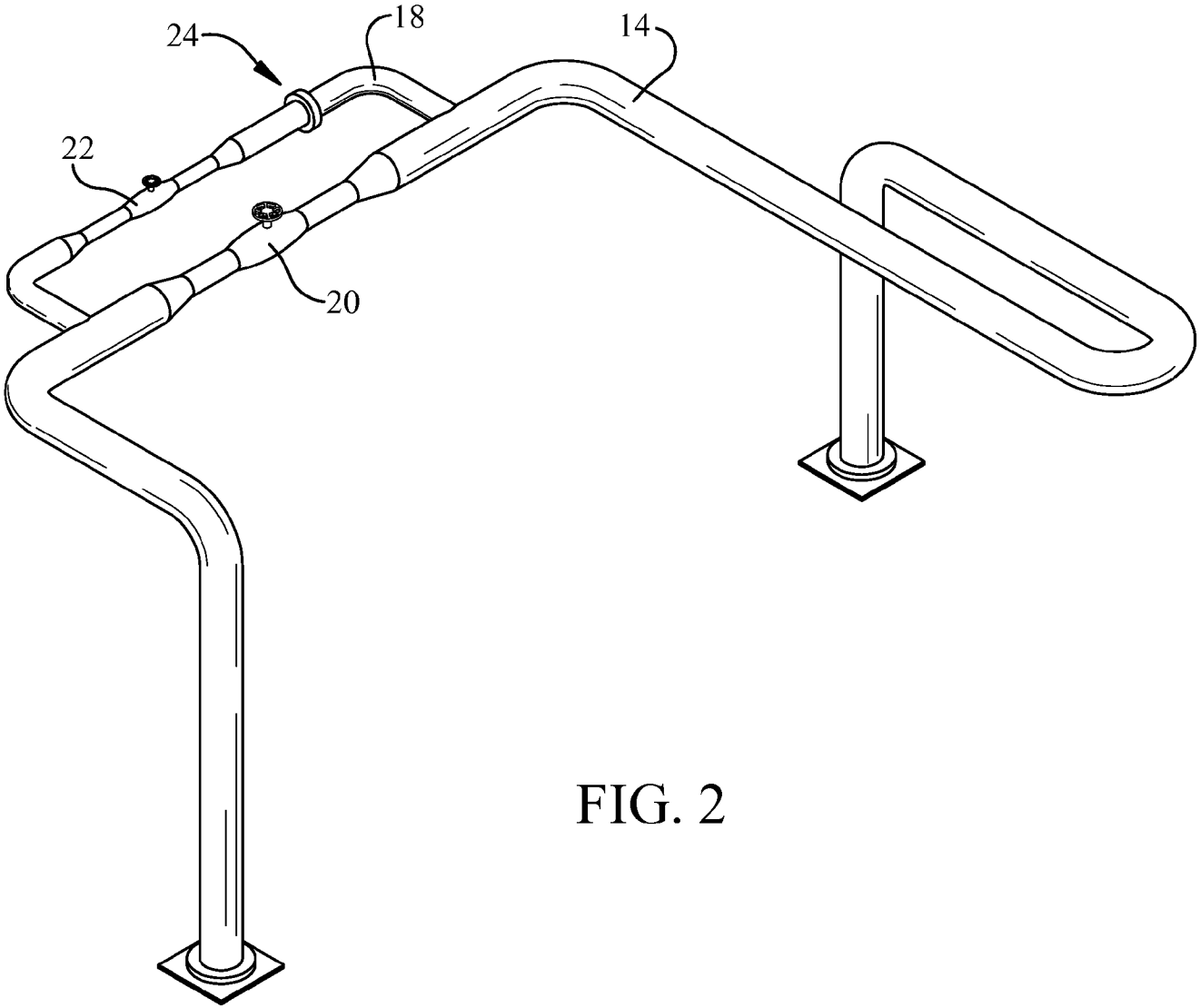
FIG. 2 shows a three-dimensional perspective view of a portion of a system according to various embodiments of the invention.

FIG. 2 shows a three-dimensional perspective view of a portion of the system 2 of FIG. 1, with particular focus on the main conduit 14 and main valve 20, as well as the bypass conduit 18, blocking valve 22 and the opening 24 (which includes orifice 28 with orifice plate 26, as shown in FIG. 1). As described herein, connection of the blocking valve 22 (e.g., a CSBV) in parallel with the main valve 20 allows for the main valve 20 (e.g., RHCV) to function as desired without the need for a cross-drilled hole (as in the conventional configuration). Without a cross-drilled hole, the configuration produces less noise in high-flow situations.

As noted herein, the control system 30 (FIG. 1) is configured to control operation of the main valve 20 and the blocking valve 22 to provide for desired flow conditions between the HP 4, packing 16 and IP 13. The control system 30 is configured (e.g., programmed) to control operation of one or more of the valves (e.g., main valve 20 and blocking valve 22) via any means described herein and/or known in the art.

As will be appreciated by one skilled in the art, the control system 30 described herein may be embodied as a system(s), method(s) or computer program product(s), e.g., as part of a turbine monitoring system. Accordingly, embodiments of the present invention may take the form of an entirely hardware embodiment, an entirely software embodiment (including firmware, resident software, micro-code, etc.) or an embodiment combining software and hardware aspects that may all generally be referred to herein as a "circuit," "module" or "system." Furthermore, the present invention may take the form of a computer program product embodied in any tangible medium of expression having computer-usable program code embodied in the medium.

Any combination of one or more computer usable or computer readable medium(s) may be utilized. The computer-usable or computer-readable medium may be, for example but not limited to, an electronic, magnetic, optical, electromagnetic, infrared, or semiconductor system, apparatus, or device. More specific examples (a non-exhaustive list) of the computer-readable medium would include the following: an electrical connection having one or more wires, a portable computer diskette, a hard disk, a random access memory (RAM), a read-only memory (ROM), an erasable programmable read-only memory (EPROM or Flash memory), an optical fiber, a portable compact disc read-only memory (CD-ROM), an optical storage device, a transmission media such as those supporting the Internet or an intranet, or a magnetic storage device. Note that the computer-usable or computer-readable medium could even be paper or another suitable medium upon which the program is printed, as the program can be electronically captured, via, for instance, optical scanning of the paper or other medium, then compiled, interpreted, or otherwise processed in a suitable manner, if necessary, and then stored in a computer memory. In the context of this document, a computer-usable or computer-readable medium may be any medium that can contain, store, communicate, or transport the program for use by or in connection with the instruction execution system, apparatus, or device. The computer-usable medium may include a propagated data signal with the computer-usable program code embodied therewith, either in baseband or as part of a carrier wave. The computer usable program code may be transmitted using any appropriate medium, including but not limited to wireless, wireline, optical fiber cable, RF, etc.

Computer (or controller) program code for carrying out operations of the present invention may be written in any programming language(s), for example, but not limited to, an object oriented programming language such as Java, Magik, Smalltalk, C++ or the like and conventional procedural programming languages, such as the "C" programming language, proprietary software, controller language, embedded or similar programming languages. The program code may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider).

Embodiments of the present invention are described herein with reference to data flow illustrations and/or block diagrams of methods, apparatus (systems) and computer program products according to embodiments of the invention. It will be understood that each block of the data flow illustrations and/or block diagrams, and combinations of blocks in the flowchart illustrations and/or block diagrams, can be implemented by computer program instructions. These computer program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks.

These computer program instructions may also be stored in a computer-readable medium that can direct a computer or other programmable data processing apparatus to function in a particular manner, such that the instructions stored in the computer-readable medium produce an article of manufacture including instruction means which implement the function/act specified in the flowchart and/or block diagram block or blocks.

The computer program instructions may also be loaded onto a computer or other programmable data processing apparatus to cause a series of operational steps to be performed on the computer or other programmable apparatus to produce a computer implemented process such that the instructions which execute on the computer or other programmable apparatus provide processes for implementing the functions/acts specified in the flowchart and/or block diagram block or blocks.

Figure 3:
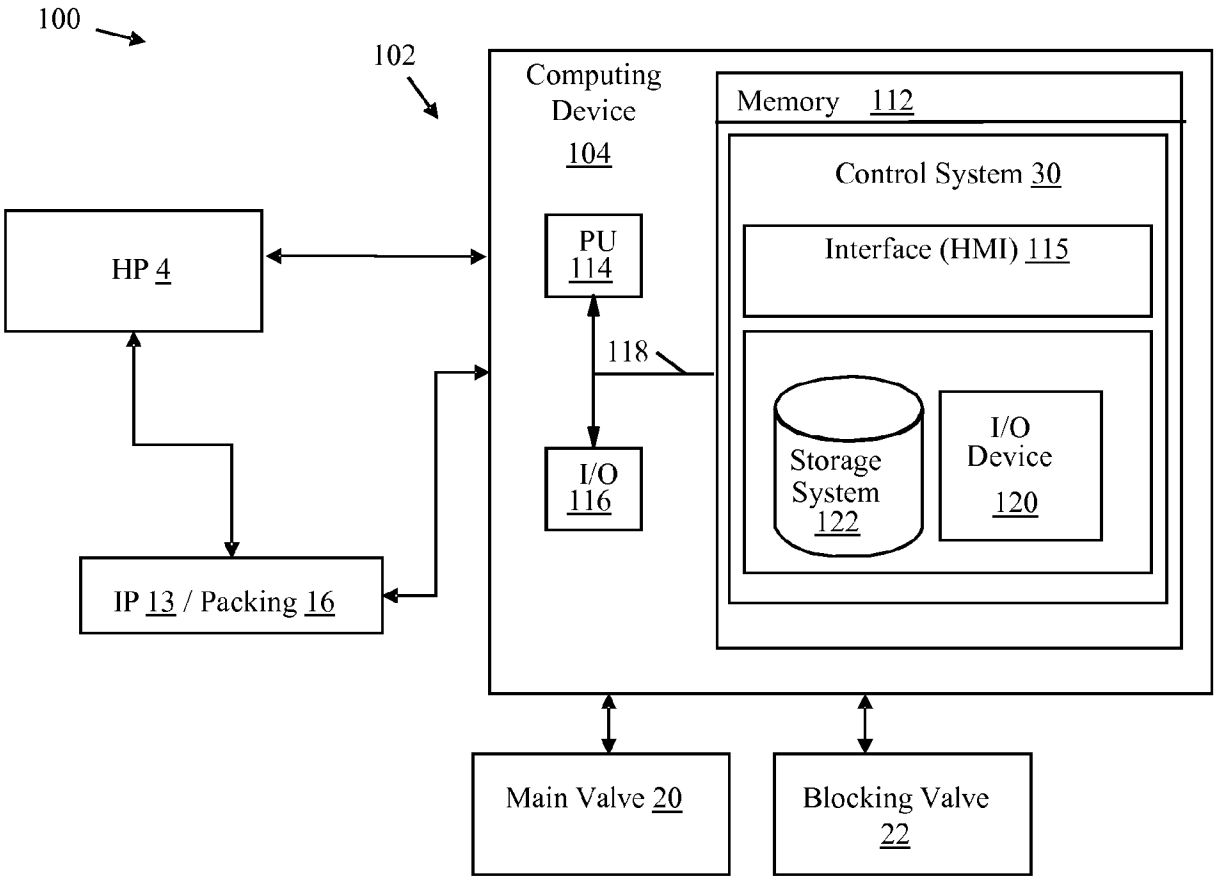
FIG. 3 shows an illustrative environment including a system according to various embodiments of the invention.

Turning to FIG. 3, an illustrative environment 100 including the control system 30 is shown according to embodiments of the invention. Environment 100 includes a computer infrastructure 102 that can perform the various processes described herein. In particular, computer infrastructure 102 is shown including a computing device 104 that comprises the control system 30, which enables computing device 104 to provide real-time control of the main valve 20 and/or blocking valve 22, by performing the processes of the disclosure. It is understood that the control system 30 can include an interface (e.g., a human machine interface (HMI)) 115 configured to execute some or all of the functions of the control system 30 described herein. The interface 115 can include one or more I/O devices 120 having one or more displays, actuatable buttons, touch screens, etc. for allowing a human operator to interact with the control system 30. In some cases, the interface 115 can include a standard industrial human-machine/man-machine interface (HMI/MMI) system which can act as an interface between human and machine, human and plant, machine and software etc.

Computing device 104 is shown including a memory 112, a processor (PU) 114, an input/output (I/O) interface 116, and a bus 118. Further, computing device 104 is shown including an I/O device/resource 120 and a storage system 122. As is known in the art, in general, processor 114 executes computer program code, such as control system 16, that is stored in memory 112 and/or storage system 122. While executing computer program code, processor 114 can read and/or write data, such as temperature data (e.g., obtained from temperature sensors), pressure data (e.g., obtained from one or more pressure sensors) to/from memory 112, storage system 122, and/or I/O interface 116. Bus 118 provides a communications link between each of the components in computing device 104. I/O device 120 can comprise any device that enables a user to interact with computing device 104 or any device that enables computing device 104 to communicate with one or more other computing devices. Input/output devices (including but not limited to keyboards, displays, pointing devices, etc.) can be coupled to the system either directly or through intervening I/O controllers.

As shown in FIG. 3, environment 100 may optionally include the HP turbine (HP) 4, IP turbine (IP) 13 and packing 16, operably connected to the control system 30 (e.g., via the computing device 104), where the computing device 104 and HP 4, IP 13 and/or packing 16 are connected via any type of conventional network, for example, an industrial/home/IP/serial network. The can be connected to the control system 30 (via computing device 104) via conventional means (e.g., via wireless or hard-wired means).

In any event, computing device 104 can comprise any general purpose computing article of manufacture capable of executing computer program code installed by a user (e.g., a personal computer, server, handheld device, etc.). However, it is understood that computing device 104 and control system 30 are only representative of various possible equivalent computing devices that may perform the various process steps of the disclosure. To this extent, in other embodiments, computing device 104 can comprise any specific purpose computing article of manufacture comprising hardware and/or computer program code for performing specific functions, any computing article of manufacture that comprises a combination of specific purpose and general purpose hardware/software, or the like. In each case, the program code and hardware can be created using standard programming and engineering techniques, respectively.

Similarly, computer infrastructure 102 is only illustrative of various types of computer infrastructures for implementing the disclosure. For example, in one embodiment, computer infrastructure 102 comprises two or more computing devices (e.g., a server cluster) that communicate over any type of wired and/or wireless communications link, such as a network, a shared memory, or the like, to perform the various process steps of the disclosure. When the communications link comprises a network, the network can comprise any combination of one or more types of networks (e.g., the Internet, a wide area network, a local area network, a virtual private network, etc.). Network adapters may also be coupled to the system to enable the data processing system to become coupled to other data processing systems or remote printers or storage devices through intervening private or public networks. Modems, cable modem and Ethernet cards are just a few of the currently available types of network adapters. Regardless, communications between the computing devices may utilize any combination of various types of transmission techniques.

As mentioned herein, control system 30 has the technical effect of enabling computing infrastructure 102 to perform, among other things, the fluid flow control/regulation functions described herein. It is understood that some of the various components shown in FIG. 3 can be implemented independently, combined, and/or stored in memory for one or more separate computing devices that are included in computer infrastructure 102. Further, it is understood that some of the components and/or functionality may not be implemented, or additional schemas and/or functionality may be included as part of environment 100.

The terminology used herein is for the purpose of describing particular embodiments only and is not intended to be limiting of the disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. It is further understood that the terms "front" and "back" are not intended to be limiting and are intended to be interchangeable where appropriate.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

We claim:

1. A system comprising:

a high pressure (HP) steam turbine including a plurality of stages, the plurality of stages including an early stage, a middle stage and a later stage;

an intermediate pressure (IP) steam turbine operably connected with the HP steam turbine;

a packing separating the HP steam turbine and the IP steam turbine;

a main conduit fluidly connecting the middle stage of the HP steam turbine and the packing, the main conduit including a main valve; and a bypass conduit fluidly connected to the main conduit and bypassing the main valve, the bypass conduit including:

a blocking valve; and an opening between the blocking valve and a downstream connection with the main conduit.

2. The system of claim 1, further comprising a control system operably connected with the main valve and the blocking valve.

3. The system of claim 2, the control system configured to perform the following:

monitor an operating parameter of the HP steam turbine; and adjust a position of at least one of the main valve or the blocking valve in response to the operating parameter deviating from a predetermined range.

4. The system of claim 3, wherein the operating parameter is an operating load of the HP steam turbine.

5. The system of claim 4, wherein the control system is configured to close the main valve and open the bypass valve in response to determining the operating load of the HP steam turbine exceeds a predetermined threshold.

6. The system of claim 4, wherein the control system is configured to close both of the main valve and the bypass valve in response to determining a malfunction has occurred.

7. The system of claim 1, wherein the main valve includes a ball valve, and wherein the main valve is devoid of a cross-drilled hole.

8. The system of claim 1, wherein the opening includes an orifice plate and an orifice, wherein the opening meters steam flow during operation of the HP steam turbine and the IP steam turbine at base load.

9. The system of claim 1, wherein the bypass conduit has an inner diameter approximately 10-20 percent smaller than an inner diameter of the main conduit, such that a lesser fluid flow rate is permitted through the bypass conduit than the main conduit.

10. The system of claim 1, wherein the HP steam turbine and the IP steam turbine are connected along a common shaft.

11. A system comprising:

a high pressure (HP) steam turbine;

a packing separating the HP steam turbine from an IP steam turbine;

a main conduit fluidly connecting a middle stage of the HP steam turbine and the packing, the main conduit including a main valve, wherein the main valve is devoid of a cross-drilled hole; and a bypass conduit fluidly connected to the main conduit and bypassing the main valve, the bypass conduit including:

a blocking valve; and an opening between the blocking valve and a downstream connection with the main conduit.

12. The system of claim 11, wherein the main valve includes a ball valve.

13. The system of claim 12, wherein the opening includes an orifice plate and an orifice, wherein the opening meters fluid flow during operation of the HP steam turbine and the IP steam turbine at base load.

14. The system of claim 11, wherein the bypass conduit has an inner diameter approximately 10-20 percent smaller than an inner diameter of the main conduit, such that a lesser fluid flow rate is permitted through the bypass conduit than the main conduit.

15. A system comprising:

at least one computing device configured to monitor a reheat steam bypass system by performing actions including:

determining an operating parameter of a high-pressure (HP) steam turbine fluidly connected with a packing; and adjusting a position of at least one of a reheat rotor cooling valve (RHCV) or a cooling steam blocking valve (CSBV) to modify a flow of main steam in the reheat steam bypass system in response to the operating parameter of the HP steam turbine deviating from a predetermined range, wherein the RHCV and the CSBV are connected in parallel in the reheat steam bypass system.

16. The system of claim 15, wherein the operating parameter is an operating load of the HP steam turbine.

17. The system of claim 16, wherein the at least one computing device is further configured to close the RHCV and open the CSBV in response to determining the operating load of the HP steam turbine deviates from the predetermined range.

18. The system of claim 16, wherein the at least one computing device is further configured to close both of the RHCV and the CSBV in response to determining a malfunction has occurred in the HP steam turbine.

* * * * *